US009758347B2

(12) United States Patent
Dudde et al.

(10) Patent No.: US 9,758,347 B2
(45) Date of Patent: Sep. 12, 2017

(54) ARRANGEMENT AND METHOD TO MOVE AT LEAST TWO ELEVATOR CARS INDEPENDENTLY IN AT LEAST ONE HOISTWAY

(71) Applicant: ThyssenKrupp Elevator AG and ThyssenKrupp AG, Essen (DE)

(72) Inventors: Frank Dudde, Collierville, TN (US); Peter Feldhusen, Collierville, TN (US)

(73) Assignee: ThyssenKrupp Elevator AG; ThyssenKrupp AG, Essen (DE)

( * ) Notice: Subject to any disclaimer, the term of this patent is extended or adjusted under 35 U.S.C. 154(b) by 337 days.

(21) Appl. No.: 14/557,683

(22) Filed: Dec. 2, 2014

(65) Prior Publication Data

US 2016/0152446 A1 Jun. 2, 2016

(51) Int. Cl.
*B66B 9/00* (2006.01)

(52) U.S. Cl.
CPC ..... *B66B 9/00* (2013.01); *B66B 9/003* (2013.01)

(58) Field of Classification Search
CPC ..... B66B 9/00; B66B 9/003
See application file for complete search history.

(56) References Cited

U.S. PATENT DOCUMENTS 1,859,483 A * 5/1932 Winslow ..... B66B 9/003 187/270
1,943,119 A * 1/1934 James ..... B66B 9/10 198/322
3,317,005 A * 5/1967 Kehoe ..... B66B 9/003 104/25
3,651,893 A 3/1972 Berkovitz
3,658,155 A * 4/1972 Salter ..... B66B 9/00 187/270
3,896,736 A * 7/1975 Hamy ..... B66B 9/003 104/127
5,651,426 A 7/1997 Bittar et al.
5,660,249 A 8/1997 Powell et al.
5,816,368 A * 10/1998 Barrett ..... B66B 7/022 187/249
5,865,274 A 2/1999 Kiji et al.
5,877,462 A 3/1999 Chenais
6,354,404 B1 * 3/2002 Sansevero ..... B66B 9/02 187/249
6,955,245 B2 10/2005 Dunser et al.
(Continued)

FOREIGN PATENT DOCUMENTS

DE 699519 11/1940
DE 1912520 9/1970
(Continued)

*Primary Examiner* — Michael Riegelman
(74) *Attorney, Agent, or Firm* — The Webb Law Firm

(57) ABSTRACT

An elevator arrangement includes two or more hoistways, at least one more elevator car than a total number of hoistways, and at least one more belt system than the total number of hoistways. At least one belt system may be provided between each pair of hoistways. At least one elevator car may be provided in each hoistway. Each elevator car may be connected to at least one belt system. The belt systems may provide a direct transfer of mechanical energy between the elevator cars. As a first elevator car moves downward in a first hoistway, mechanical energy may be generated via the belt systems to lift a second elevator car upwardly in a second hoistway.

17 Claims, 10 Drawing Sheets

(56) References Cited

U.S. PATENT DOCUMENTS

| | | | | |
|---|---|---|---|---|
| 7,213,685 | B2 | 5/2007 | Hikita | |
| 7,537,089 | B2 | 5/2009 | Duenser et al. | |
| 7,621,376 | B2 | 11/2009 | Duenser et al. | |
| 2006/0163008 | A1 | 7/2006 | Godwin | |
| 2007/0034453 | A1* | 2/2007 | Kim | B66B 9/022 187/391 |
| 2008/0149428 | A1* | 6/2008 | Kocher | B66B 9/00 187/249 |
| 2011/0042168 | A1* | 2/2011 | Grundmann | B66B 9/00 187/249 |
| 2016/0039638 | A1* | 2/2016 | Lehtinen | B66B 11/0095 187/266 |

FOREIGN PATENT DOCUMENTS

| | | | |
|---|---|---|---|
| EP | 1693331 | A1 | 8/2006 |
| EP | 2709939 | A1 | 3/2014 |
| GB | 2320013 | A | 10/1998 |
| JP | 3177293 | A | 8/1991 |
| JP | 4338084 | A | 11/1992 |
| JP | 5124781 | A | 5/1993 |
| JP | 930756 | A | 2/1997 |
| JP | 3035111 | B2 | 4/2000 |
| JP | 2000185885 | A | 7/2000 |
| JP | 2005187125 | A | 7/2005 |
| WO | 2009036232 | A3 | 3/2009 |
| WO | 2012154178 | A1 | 11/2012 |
| WO | 2012156583 | A1 | 11/2012 |

* cited by examiner

ARRANGEMENT AND METHOD TO MOVE AT LEAST TWO ELEVATOR CARS INDEPENDENTLY IN AT LEAST ONE HOISTWAY

BACKGROUND OF THE INVENTION

Field of the Invention

This disclosure relates generally to elevator arrangements and, more particularly, to an elevator arrangement configured to move at least two elevator cars independently in at least one hoistway.

Description of Related Art

Elevator arrangements and methods of moving elevator arrangements in hoistways are well known in the art. Many of the existing elevator arrangements include one elevator car assigned to one hoistway. In current elevator arrangements, the number of elevator cars needed to satisfy the traffic demand in a building is equal to the number of hoistways provided in the elevator arrangement. The building floor area occupied by the hoistways is typically not available for renting or selling. In an effort to obtain more useful building area (or in existing buildings, more traffic capacity), elevator arrangements with more than one elevator car in at least one hoistway were introduced. These elevator arrangements included linear motor propulsion systems or multiple machine rooms on top of the hoistways to move the elevator cars in the arrangement.

European Patent No, EP 1 693 331, the disclosure of which is herein incorporated by reference in its entirety, discloses an example of one such elevator arrangement. In this elevator arrangement, each car is assigned to one hoistway propulsion system in the assigned hoistway. Any changes of the assigned elevator car and/or hoistway propulsion system are not possible as long as the elevator car stays in the assigned hoistway. The necessary number of hoistway propulsion systems is equal to the maximum number of elevator cars in each hoistway.

A further elevator arrangement is shown in Japanese Patent Nos. JP 3177293 and JP 930756, the disclosures of which are herein incorporated by reference in their entirety. These elevator arrangements use multiple overlapping propulsion systems in one hoistway to assure a continuous car movement during the exchange of the cars within the hoistway propulsion system. The multiple overlapping propulsion systems require more available space in each hoistway and can often interrupt the movement of the elevator cars, thereby causing turbulence when moving through the hoistways.

Another elevator arrangement is disclosed in International Patent Application Publication No, WO 2009/036232, the disclosure of which is herein incorporated by reference in its entirety. In this elevator arrangement, the hoistway propulsion system is mounted on the front and rear walls of the hoistway. Each elevator car is driven and propelled by a single drive assembly that includes a pulley system for driving the elevator car. This elevator arrangement requires at least four parallel and simultaneous working propulsion systems to move one elevator car in one hoistway in order to reach a balanced load transfer between the propulsion/guiding system and the elevator car.

SUMMARY OF THE INVENTION

In view of the foregoing, a need exists for an elevator arrangement and method that includes a simplified design that is more economic and reliable compared to existing elevator arrangements. A further need exists for an elevator arrangement that uses low energy consumption and provides an increased ride comfort. Additionally, a need exists for an elevator arrangement that only requires a small amount of hoistway space. Another need exists for an elevator arrangement that can efficiently use mechanical energy to operate the movement of elevator cars within the elevator arrangement.

Accordingly, and generally, an elevator arrangement and a method of moving the elevator arrangement in at least one hoistway are provided to address and/or overcome some or all of the deficiencies or drawbacks associated with existing elevator arrangements.

In accordance with one aspect of the disclosure, an elevator arrangement includes two or more hoistways, at least one more elevator car than a total number of hoistways, and at least one more belt system than the total number of hoistways. At least one belt system may be provided between each pair of hoistways. At least one elevator car may be provided in each hoistway. Each elevator car may be connected to at least one belt system. The belt systems may provide a direct transfer of mechanical energy between the elevator cars.

As a first elevator car moves downward in a first hoistway, mechanical energy may be generated via the belt systems to lift a second elevator car upwardly in a second hoistway. The at least one more elevator car than the total number of hoistways may include at least three elevator cars. The at least one more belt system than the total number of hoistways may include at least three belt systems. The belt systems may include a hoistway belt set positioned between an upper exchanger belt set and a lower exchanger belt set. An air gap may be provided between each of the upper exchanger belt set, the hoistway belt set, and the lower exchanger belt set. The elevator arrangement may also include at least two guiding systems. At least one guiding system may be provided at an upper portion of the elevator arrangement and at least one guiding system may be provided at a lower portion of the elevator arrangement. The at least two guiding systems may be configured to move the elevator cars between the hoistways. A magnetic connection arrangement may be configured to establish a connection between each elevator car and the belt systems. A magnetic force may be established between each elevator car and the belt systems to hold each elevator car to the belt systems. A friction clamping connection arrangement may be configured to establish a connection between each elevator car and the belt systems. The friction clamping connection arrangement may include at least two clamping members. The belt systems may define at least two grooves configured to receive the at least two clamping members. The at least two clamping members may be moved in opposite directions relative to one another to create a clamping force on a clamping portion between the at least two grooves in the belt systems. A positive locking connection arrangement may be provided between each elevator car and the belt systems. The positive locking connection arrangement may include a plurality of teeth provided on the belt systems and a plurality of teeth provided on each elevator car. The plurality of teeth provided on the belt systems may positively interlock with the plurality of teeth provided on the elevator cars. The positive locking connection arrangement may also include an actuator on each elevator car configured to extend the plurality of teeth of each elevator car in a lateral direction relative to each elevator car. A pneumatic connection arrangement may be provided between each elevator car and the belt systems. The pneumatic connection arrangement may create a vacuum seal between each elevator car and the belt systems. The pneumatic connection arrangement may include at least one vacuum chamber and at least one vacuum pump provided in the at least one vacuum chamber. The vacuum pump may be configured to remove air from the vacuum chamber to bring the pressure level of the vacuum chamber below atmospheric level. A master controller may be configured to communicate with each elevator car to activate each elevator car to move within the elevator arrangement. At least one car controller may be provided in each elevator car. The car controller may be configured to communicate with the master controller. The belt systems may include a drive belt and at least one start/stop belt. At least one motor may be provided on the belt systems. The at least one motor may be configured to move the belt systems at a constant nominal speed.

In accordance with another aspect of the disclosure, a method of moving at least three elevator cars in at least two hoistways of an elevator arrangement may include the steps of connecting at least three elevator cars to at least one common belt system; generating mechanical energy in the at least one common belt system by moving at least one of the elevator cars downward in at least one hoistway; and using the mechanical energy to lift at least one of the elevator cars upward in at least one hoistway. The method may also include the step of moving each elevator car over air gaps provided at at least one location on the at least one common belt system. The method may also include the steps of each elevator car communicating with a master controller; and the master controller activating each elevator car to move within the elevator arrangement.

The method may further include accelerating a start/stop belt of the at least one common belt system until the start/stop belt reaches a substantially same speed as a drive belt of the at least one common belt system. The method may further include disconnecting at least one elevator car from the drive belt and connecting the at least one elevator car to the start/stop belt. The method may further include moving the at least one elevator car via the start/stop belt to a predetermined location if the at least one elevator car is disconnected from the drive belt, and clamping the at least one elevator car to a support structure via a safety rail brake system if a speed of the at least one elevator car is substantially zero. The method may further include disconnecting the at least one elevator car from the start/stop belt.

These and other features and characteristics of the elevator arrangement, as well as the method of moving the elevator arrangement in at least one hoistway, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a", "an", and "the" include plural referents unless the context clearly dictates otherwise.

DESCRIPTION OF THE DISCLOSURE

For purposes of the description hereinafter, the terms "upper", "lower", "right", "left", "vertical", "horizontal", "top", "bottom", "lateral", "longitudinal", and derivatives thereof shall relate to the disclosure as it is oriented in the figures. However, it is to be understood that the disclosure may assume alternative variations and step sequences, except where expressly specified to the contrary. It is also to be understood that the specific arrangements and processes illustrated in the attached drawings, and described in the following specification, are simply exemplary aspects of the disclosure. Hence, specific dimensions and other physical characteristics related to the aspects disclosed herein are not to be considered as limiting.

The present disclosure is directed to, in general, an elevator arrangement and, in particular, to an elevator arrangement configured to move at least two elevator cars independently in at least one hoistway. Certain exemplary and non-limiting aspects of the components of the elevator arrangement are illustrated in FIGS. 1-10.

Figure 1:
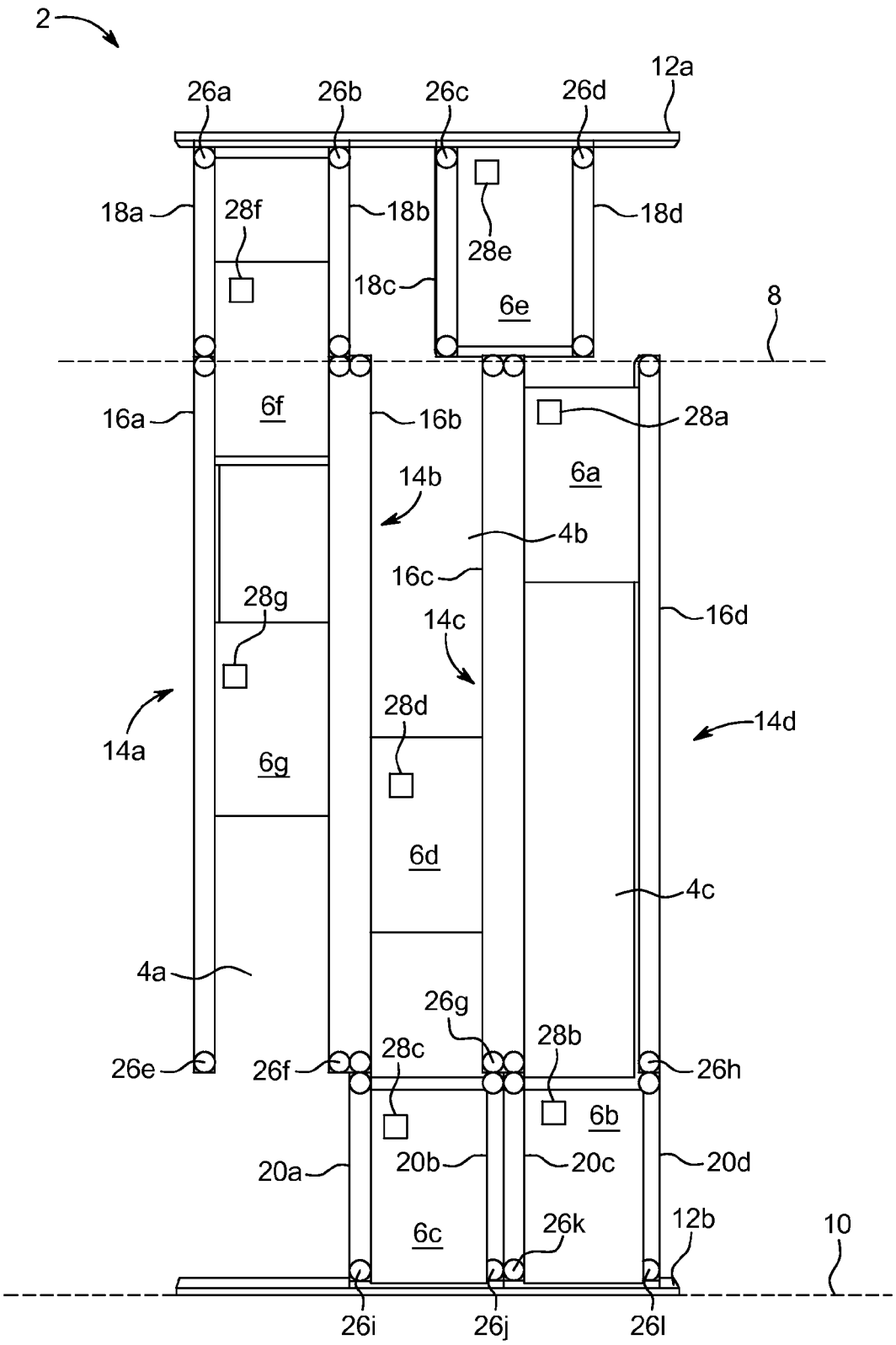
FIG. 1 is a front view of an elevator arrangement in accordance with one aspect of the present disclosure.
Figure 2:
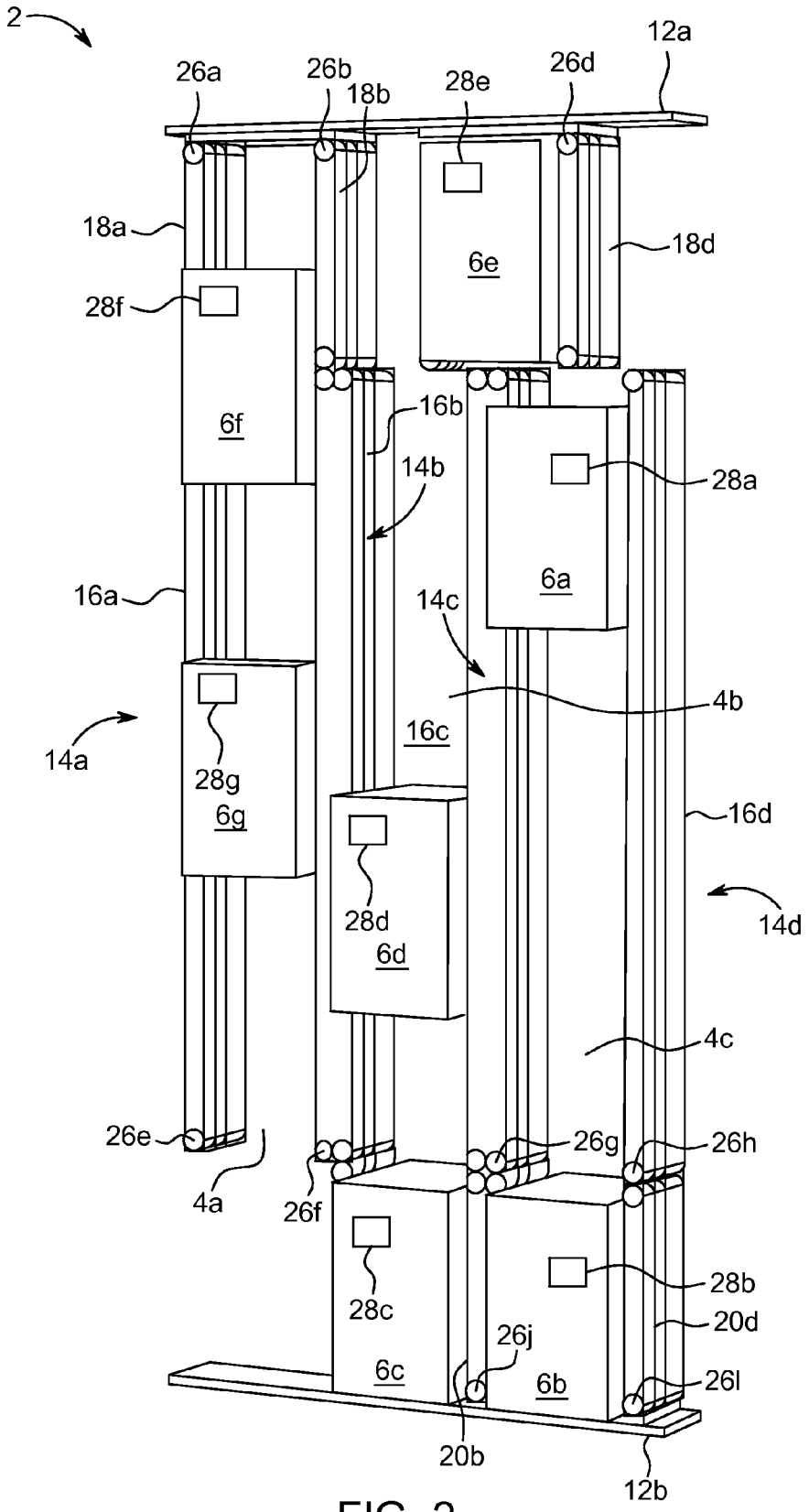
FIG. 2 is a front perspective view of the elevator arrangement of FIG. 1.
Figure 3:
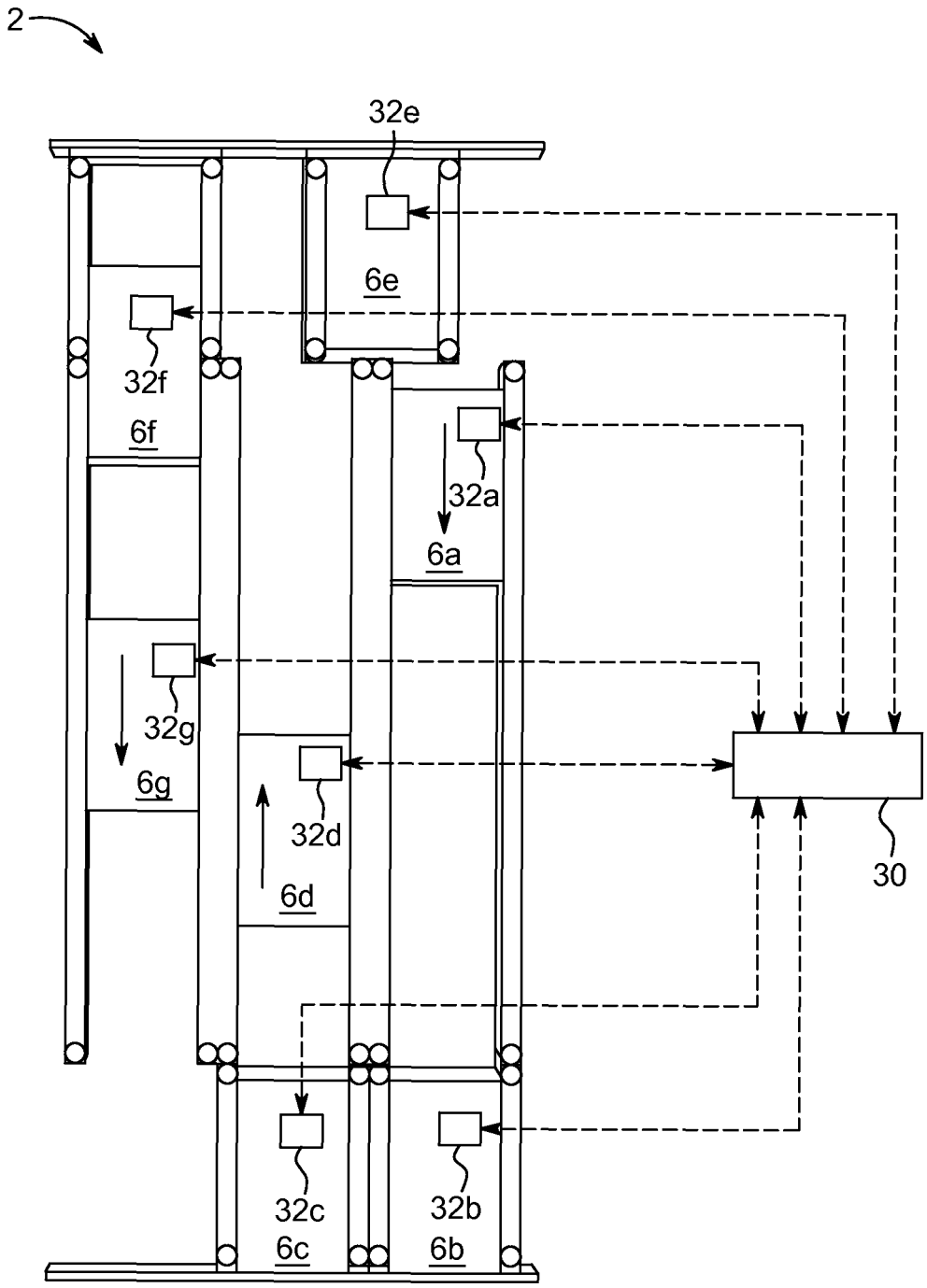
FIG. 3 is a front view of an elevator arrangement in accordance with another aspect of the present disclosure depicting a controller system used in the elevator arrangement.

With reference to FIGS. 1-3, an elevator arrangement 2 according to the present disclosure is shown and described. In one aspect, the elevator arrangement 2 may include at least two hoistways 4*a*-4*c* and at least two elevator cars 6*a*-6*g* In a further aspect, the elevator arrangement may include, for example, three hoistways 4*a*-4*c* and, for example, seven elevator cars 6*a*-6*g*. The hoistways 4*a*-4*c* are understood to be passageways in the elevator arrangement 2 through which the elevator cars 6*a*-6*g* are configured to travel. It is to be understood, however, that additional or fewer hoistways and/or elevator cars may be included in the elevator arrangement 2 according to the desired passenger capacity. It is contemplated that the elevator arrangement 2 may be constructed in a new building or an existing building that includes several preexisting hoistways. The elevator arrangement 2 may be positioned between a top floor 8 of a building and a bottom floor 10 of the building. However, the elevator arrangement 2 may be provided at an intermediate position between the top floor 8 and the bottom floor 10. It is also contemplated that the elevator arrangement 2 may only extend from the top floor 8 to an intermediate position, or from the bottom floor 10 to an intermediate position.

The elevator arrangement 2 may include at least two guiding systems 12*a*, 12*b*. The guiding systems 12*a*, 12*b* may be positioned at the top floor 8 and the bottom floor 10. It is also contemplated that additional guiding systems (not shown) may be provided in the elevator arrangement 2 at intermediate positions between the top floor 8 and the bottom floor 10. The guiding systems 12*a*, 12*b* may be configured to position and move the elevator cars 6*a*-6*g* between different hoistways 4*a*-4*c* in the elevator arrangement 2. The guiding systems 12*a*, 12*b* may be configured to receive the elevator cars 6*a*-6*g* and move the elevator cars 6*a*-6*g* in a lateral or horizontal direction relative to the elevator arrangement 2. In one aspect, the guiding systems 12*a*, 12*b* may include a guide rail system along which the elevator cars 6*a*-6*g* may travel. A driver or motor (not shown) may be positioned on the side of the guiding systems 12*a*, 12*b* to provide the necessary power to operate the guiding systems 12*a*, 12*b*. The guiding systems 12*a*, 12*b* may either clamp onto the elevator cars 6*a*-6*g* or the elevator cars 6*a*-6*g* may clamp onto the guiding systems 12*a*, 12*b*. The guiding systems 12*a*, 12*b* may be independent and separate from other propulsion systems used in the elevator arrangement 2, as will be described in greater detail below. The guiding systems 12*a*, 12*b* may be positioned on the top surface or ceiling of the hoistways 4*a*-4*c*, and the bottom surface or floor of the hoistways 4*a*-4*c*. It is also contemplated that, to increase the availability of elevator cars 6*a*-6*g* during peak operating hours (e.g. morning and evening), an additional guiding system (not shown) may be provided at an intermediate location between the guiding systems 12*a*, 12*b*, which can create a shortcut between the guiding systems 12*a*, 12*b*. For example, during the upward morning traffic in the elevator arrangement 2, a first hoistway 4*a* may serve the upper levels of the building and a second hoistway 4*b* may service the lower levels of the building. In this situation, the second hoistway 4*b* could use an intermediate guiding system to transport the elevator cars 6*a*-6*g* from the second hoistway 4*b* to a third hoistway 4*c*, a hoistway that includes downward moving elevator cars 6*a*-6*g*.

The elevator arrangement 2 may also include a plurality of propulsion systems 14*a*-14*d*. The propulsion systems 14*a*-14*d* may be configured to move the elevator cars 6*a*-6*g* in a vertical direction within the elevator arrangement 2. The propulsion systems 14*a*-14*d* may be connected to the elevator cars 6*a*-6*g* via a connection arrangement, as described in greater detail below. In one aspect, a propulsion system 14*a*-14*d* may be positioned on each side of each hoistway 4*a*-4*c*. It is contemplated that the arrangement of propulsion systems 14*a*-14*d* may be configured to optimize the elevator arrangement 2 traffic by switching the direction of the movement of each propulsion systems 14*a*-14*d* depending on the time of day (e.g. upward moving morning traffic or downward moving evening traffic). For example, a three hoistway 4*a*-4*c* elevator arrangement 2 may have an operation mode in which two hoistways 4*a*, 4*b*, for example, may move in an upward direction and a third hoistway 4*c*, for example, may be moved in a downward direction to accommodate the morning elevator traffic. Similarly, during the evening elevator traffic, two hoistways 4*a*, 4*b*, for example, may be moved in a downward direction and a third hoistway 4*c*, for example, may be moved in an upward direction to accommodate the elevator traffic leaving the building. Each propulsion system 14*a*-14*d* may include a hoistway belt set 16*a*-16*d*, an upper exchanger belt set 18*a*-18*d*, and a lower exchanger belt set 20*a*-20*d*. It is also contemplated that, for higher buildings with a higher travel height, the hoistway belt sets 16*a*-16*d* may be divided into several different sections. For example, for a building having a 100 m travel height, the hoistway belt sets 16*a*-16*d* may be divided into four separate 25 m hoistway belt sets. In one aspect, the hoistway belt set 16*a*-16*d* may be positioned between the upper exchanger belt set 18*a*-18*d* and the lower exchanger belt set 20*a*-20*d*. The upper exchanger belt set 18*a*-18*d* and the lower exchanger belt set 20*a*-20*d* may be moved from hoistway to hoistway to move the elevator cars 6*a*-6*g* between hoistways 4*a*-4*c*. In one aspect, the upper and lower guiding systems 12*a*, 12*b* may be used to move the upper exchanger belt sets 18*a*-18*d* and the lower exchanger belt sets 20*a*-20*d* between the hoistways. The propulsion systems 14*a*-14*d* may be configured to move the elevator cars 6*a*-6*g* within the elevator arrangement 2. The propulsion systems 14*a*-14*d* may be positioned or provided adjacent the sides of the elevator cars 6*a*-6*g*. By providing the propulsion systems 14*a*-14*d* adjacent the sides of the elevator cars 6*a*-6*g* and not adjacent the front and/or rear sides of the elevator cars 6*a*-6*g*, the propulsion systems 14*a*-14*d* do not and cannot interfere with the opening and/or closing of the doors of the elevator cars 6*a*-6*g*.

Figure 4:
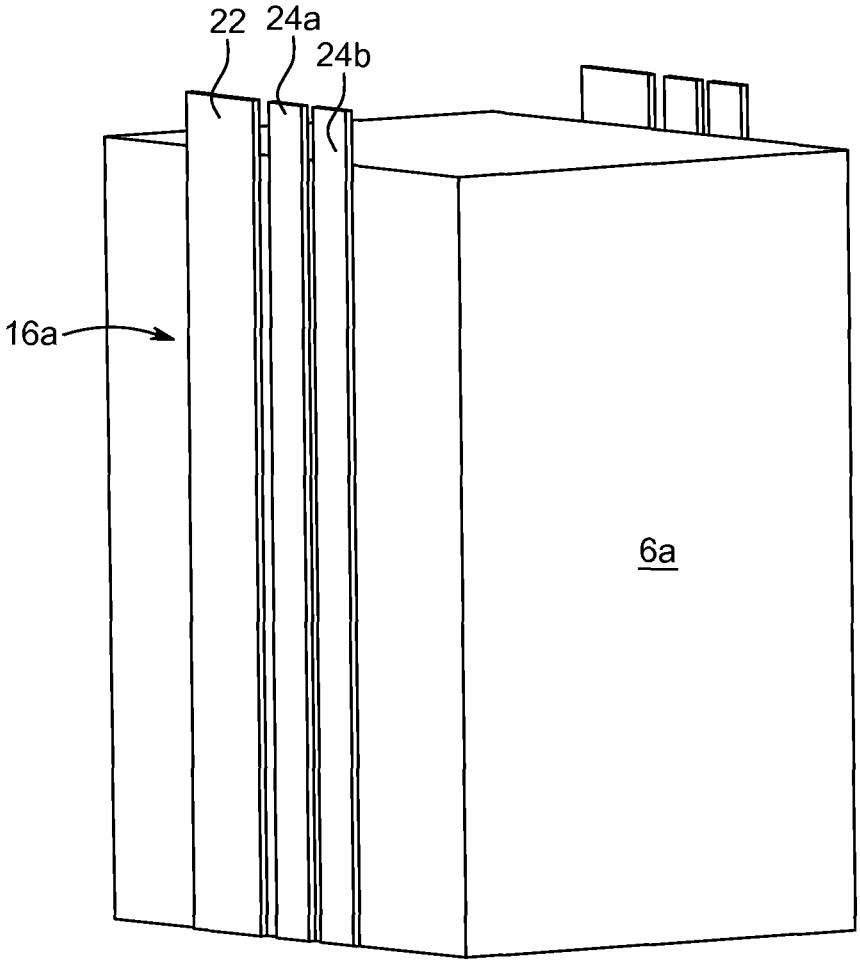
FIG. 4 is a side perspective view of a belt set used in the elevator arrangement of FIG. 1 in accordance with one aspect of the present disclosure.
Figure 6:
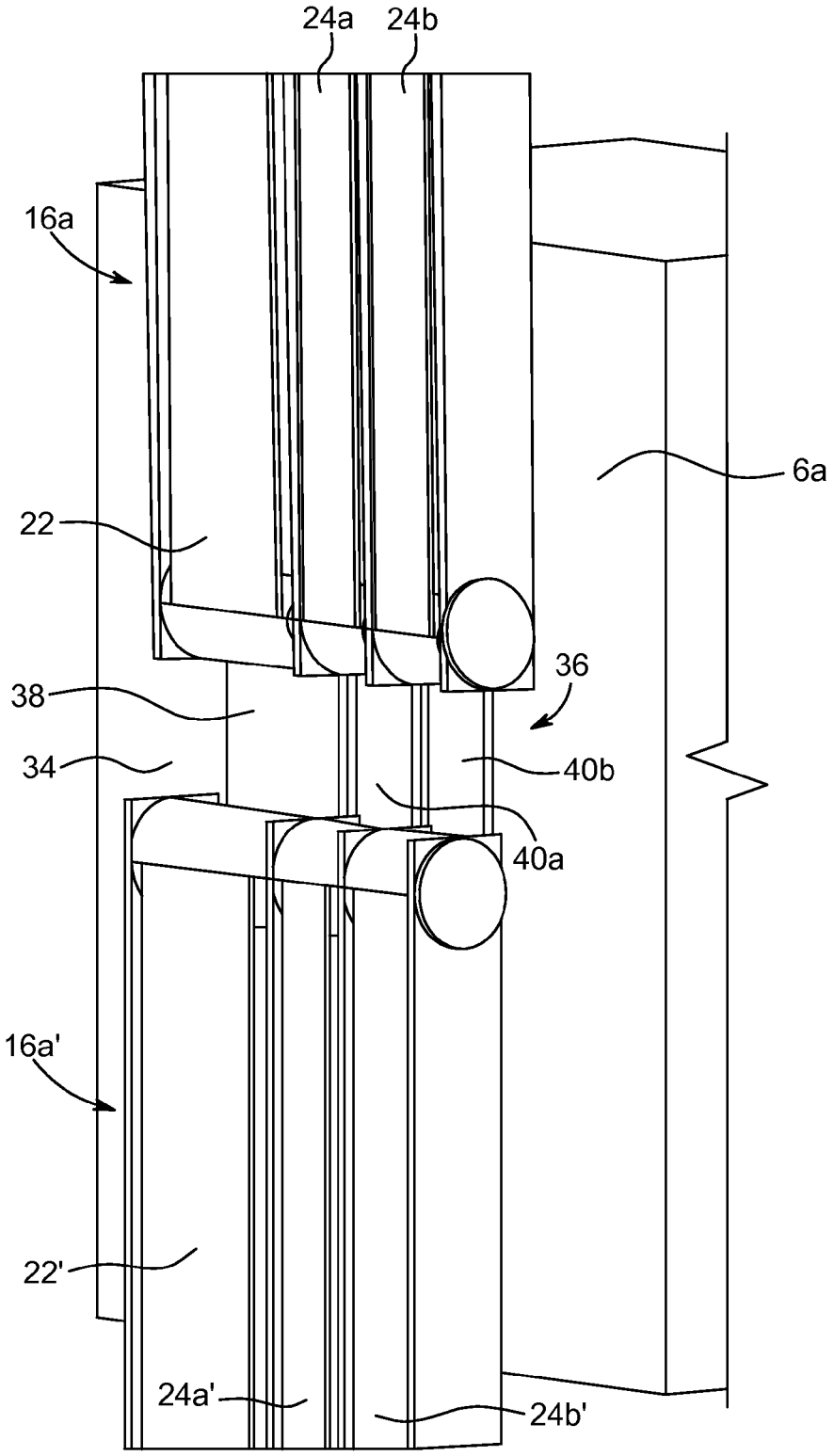

As shown in greater detail in FIG. 4, each of the hoistway belt sets 16*a*-16*d*, the upper exchanger belt sets 18*a*-18*d*, and the lower exchanger belt sets 20*a*-20*d* may include a drive belt 22 and at least one start/stop belt 24*a*, 24*b*. In one aspect, each of the hoistway belt sets 16*a*-16*d*, the upper exchanger belt sets 18*a*-18*d*, and the lower exchanger belt sets 20*a*-20*d* may include a drive belt 22 and two start/stop belts 24*a*, 24*b*. Each of the hoistway belt sets 16*a*-16*d*, the upper exchanger belt sets 18*a*-18*d*, and the lower exchanger belt sets 20*a*-20*d* may be separated by an air gap 34 (as shown in FIG. 6) so none of the hoistway belt sets 16*a*-16*d*, the upper exchanger belt sets 18*a*-18*d*, and the lower exchanger belt sets 20*a*-20*d* overlap one another. The elevator cars 6*a*-6*g* may be connected to the hoistway belt sets 16*a*-16*d*, the upper exchanger belt sets 18*a*-18*d*, and the lower exchanger belt sets 20*a*-20*d* via a temporary joint, as will be described in greater detail below. The temporary joint permits the elevator cars 6*a*-6*g* to quickly disconnect and connect to the hoistway belt sets 16*a*-16*d*, the upper exchanger belt sets 18*a*-18*d*, and the lower exchanger belt sets 20*a*-20*d* after passing over the air gaps 34 between the belt sets.

Each drive belt 22 and start/stop belt 24*a*, 24*b* may be an endless belt driven by at least one motor 26*a*-26*l* provided in the propulsion systems 14*a*-14*d*. In one aspect, each of the hoistway belt sets 16*a*-16*d*, the upper exchanger belt sets 18*a*-18*d*, and the lower exchanger belt sets 20*a*-20*d* may include one motor 26*a*-26*l*. The motors 26*a*-26*l* may be positioned at a top, bottom, and/or intermediate position on the belt sets 16*a*-16*d*, 18*a*-18*d*, 20*a*-20*d*. The drive belts 22 may be configured to operate or move constantly at a nominal elevator speed. In one aspect, the drive belts 22 may always be moving in the elevator arrangement 2 according to a desired nominal elevator traveling speed chosen by an operator of the elevator arrangement 2. It is to be understood that a nominal speed is meant to mean a slow or small amount of speed. In one aspect, the nominal speed may be between 0.5 m/s and 5 m/s. Using this nominal speed, the elevator arrangement 2 may operate in a low rise, mid-rise, or high rise building. It is also contemplated that alternative nominal speed ranges may be used with the elevator arrangement 2. By constantly moving/operating at a nominal speed, a large controller and motor are not necessary for movement of the elevator cars 6*a*-6*g*, which are often necessary to bring the elevator cars 6*a*-6*g* up to the nominal operating speed. Each start/stop belt 24*a*, 24*b* may run at a lower speed or may stop moving completely depending upon the operating condition of the elevator arrangement 2.

In one aspect, each drive belt 22 may have, for example, a width of about 400 mm and a thickness of about 4 mm. In one aspect, each start/stop belt 24*a*, 24*b* may have, for example, a width of about 200 mm and a thickness of about 4 mm. In one aspect, the sheave or pulley diameter of each propulsion system 14*a*-14*d* may be, for example, about 250 mm. It is also contemplated that belt and/or sheave cleaners (not shown) may be needed to separate debris and/or metallic parts from the belts and the sheaves.

Each elevator car 6*a*-6*g* may also include a safety rail brake system 28*a*-28*g*. The safety rail brake systems 28*a*-28*g* may be positioned on a top, bottom, or intermediate portion of each elevator car 6*a*-6*g*. The safety rail brake systems 28*a*-28*g* may be configured to engage and co-act with a corresponding vertical support structure of the propulsion systems 14*a*-14*d*. In one aspect, the vertical support structure may be a guide rail. The safety rail brake systems 28*a*-28*g* may be configured to hold the corresponding elevator cars 6*a*-6*g* at the top floor 8, the bottom floor 10, or an intermediate position in the hoistways 4*a*-4*c*, It is also contemplated that the safety rail brake systems 28*a*-28*g* may be configured to stop the elevator cars 6*a*-6*g* in the hoistways 4*a*-4*c* during an emergency situation in which the elevator cars 6*a*-6*g* must be quickly stopped. In one aspect, the safety rail brake systems 28*a*-28*g* may be configured to exert a clamping force on the vertical support structures of the propulsion systems 14*a*-14*d* to hold the elevator cars 6*a*-6*g* in a desired position. The elevator cars 6*a*-6*g* may be held by the corresponding safety rail brake systems 28*a*-28*g* in at least one of the upper exchanger belt sets 18*a*-18*d*, the lower exchanger belt sets 20*a*-20*d*, or in a stand-by position therebetween. In one aspect, when the safety rail brake systems 28*a*-28*g* are holding the elevator cars 6*a*-6*g* in a locked position, the hoistway belt sets 16*a*-16*d*, the upper exchanger belt sets 18*a*-18*d*, and the lower exchanger belt sets 20*a*-20*d* may not be connected to the elevator cars 6*a*-6*g*.

With reference to FIG. 3, a controller system for the elevator arrangement 2 is described. A master controller 30 may be in communication with separate car controllers 32*a*-32*g* provided on each elevator car 6*a*-6*g*. It is also contemplated that the master controller 30 may be one of the car controllers 32*a*-32*g* or may be housed in one of the elevator cars 6*a*-6*g* along with one of the car controllers 32*a*-32*g*. The master controller 30 may be configured to maintain the nominal speed of the elevator arrangement 2 and to initiate the transfer and movement of the elevator cars 6*a*-6*g* in the elevator arrangement 2. In one aspect, the master controller 30 may be a control panel and/or central processing unit (CPU). However, additional control systems that direct information through signals to other control systems are contemplated. In one aspect, the master controller 30 may be connected to the motors 26*a*-26*l* via the car controllers 32*a*-32*g* or directly connected to the motors 26*a*-26*l* to control the speed of the belt sets and elevator cars 6*a*-6*g* in the elevator arrangement 2. In one aspect, the car controllers 32*a*-32*g* may be control panels and/or central processing units (CPUs). However, additional control systems that direct information through signals to other control systems are contemplated. The car controllers 32*a*-32*g* may include push buttons or touchscreen control panels in the elevator cars 6*a*-6*g*, among other types of control mechanisms, that permit an individual to pick the particular floor he/she would like to move to in the elevator car 6*a*-6*g*. The car controller 32*a*-32*g* may then send this information via a signal to the master controller 30, which will operate the elevator arrangement 2 accordingly. The master controller 30 may be configured to determine the amount of available belt sets in order to reach a defined elevator car 6*a*-6*g* speed or position in an efficient and economic manner. Based on the source of the information that is sent to the master controller 30, the master controller 30 may be configured to determine the appropriate elevator car 6*a*-6*g* and hoistway 4*a*-4*c* that should be used to transport or move the individual that sent the information via one of the car controllers 32*a*-32*g*. It is also contemplated that the elevator arrangement 2 may operate in a destination dispatch system. In the destination dispatch system, an individual may place a call to a specific floor of the building in an elevator lobby. A destination dispatch controller or master controller 30 would then decide which elevator car 6*a*-6*g* and hoistway 4*a*-4*c* would best service this request from the individual. In one aspect, the car controllers 32*a*-32*g* may communicate to one another via the master controller 30 to ensure that the elevator cars 6*a*-6*g* do not contact or converge upon one another. By monitoring the location and movement of each elevator car 6*a*-6*g*, the master controller 30 may also ensure that a proper energy balance is maintained between the elevator cars 6*a*-6*g* and the hoistways 4*a*-4*c*. In one aspect, the master controller 30 may be configured to release an empty elevator car 6*a*-6*g* positioned at a top of the elevator arrangement 2 in an effort to bring a separate elevator car 6*a*-6*g* to an upper location in the elevator arrangement 2. This operation of the elevator arrangement 2 will be described in greater detail below. The master controller 30 may also be configured to determine the requisite magnetic field ramp-up and motor pre-torques necessary for smooth elevator car 6*a*-6*g* movement and stopping, as will also be described in greater detail below.

Figure 5:
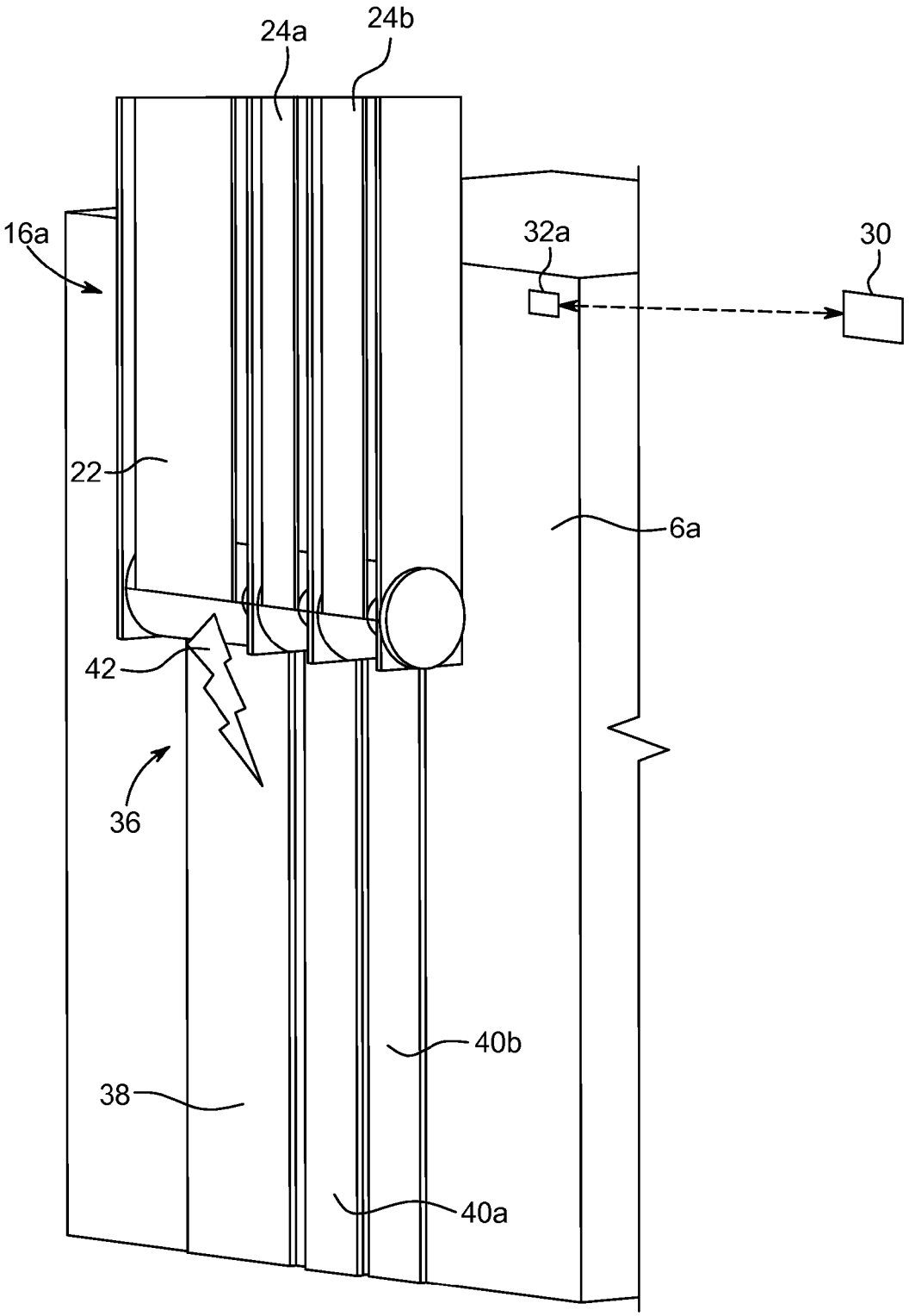
FIGS. 5 and 6 are side perspective views of a magnetic connection arrangement for the elevator arrangement of FIG. 1 in accordance with one aspect of the present disclosure.

With reference to FIGS. 5-10, the elevator cars 6*a*-6*g* may be connected to the hoistway belt sets 16*a*-16*d*, the upper exchanger belt sets 18*a*-18*d*, and the lower exchanger belt sets 20*a*-20*d* via several different aspects of connection arrangements. In FIGS. 5 and 6, a magnetic connection arrangement 36 is shown. The magnetic connection arrangement 36 may include a magnetic drive belt connector 38 and at least two magnetic start/stop belt connectors 40*a*, 40*b* positioned on a corresponding elevator car 6*a*-6*g*. In one aspect, the magnetic drive belt connector 38 and the magnetic start/stop belt connectors 40*a*, 40*b* may be electromagnetic rope. The magnetic drive belt connector 38 may be provided at a corresponding position to the drive belt 22 on the corresponding belt set. Similarly, the magnetic start/stop belt connectors 40*a*, 40*b* may be provided at a corresponding position to the start/stop belts 24*a*, 24*b* of the corresponding belt set. Upon one of the magnetic drive belt connector 38 and the magnetic start/stop belt connectors 40*a*, 40*b* being activated, the corresponding drive belt 22 and/or start/stop belt 24*a*, 24*b* is pulled to the magnetic drive belt connector 38 and/or the magnetic start/stop belt connectors 40*a*, 40*b* via a magnetic force 42. A friction force is thereby established between the corresponding belts and the magnetic connectors so the elevator car 6*a*-6*g* is connected to the corresponding belt set. In one aspect, the magnetic drive belt connector 38 and/or the magnetic start/stop belt connectors 40*a*, 40*b* may be activated by the master controller 30 via the car controller 32*d* or directly by the master controller 30. It is also contemplated that during the magnetic field ramp-up on the magnetic connectors, a limited amount of friction is established, thereby helping to balance the load during a transfer between different belt sets in the elevator arrangement 2. As best shown in FIG. 6, during the transfer of the elevator car 6*a* from one belt set 22, 24*a*, 24*b* to another belt set 22', 24*a*, 24*b*', the magnetic connection between the belt set and the magnetic belt connectors may be deactivated in the air gap 34 or transfer zone of the elevator arrangement 2. By using the magnetic connection arrangement 36, it is unnecessary to provide lubrication for the connection arrangement between the elevator car 6*a*-6*g* and the belt set, thereby reducing the maintenance and repair for the connection arrangement and the elevator arrangement 2.

Figure 7:
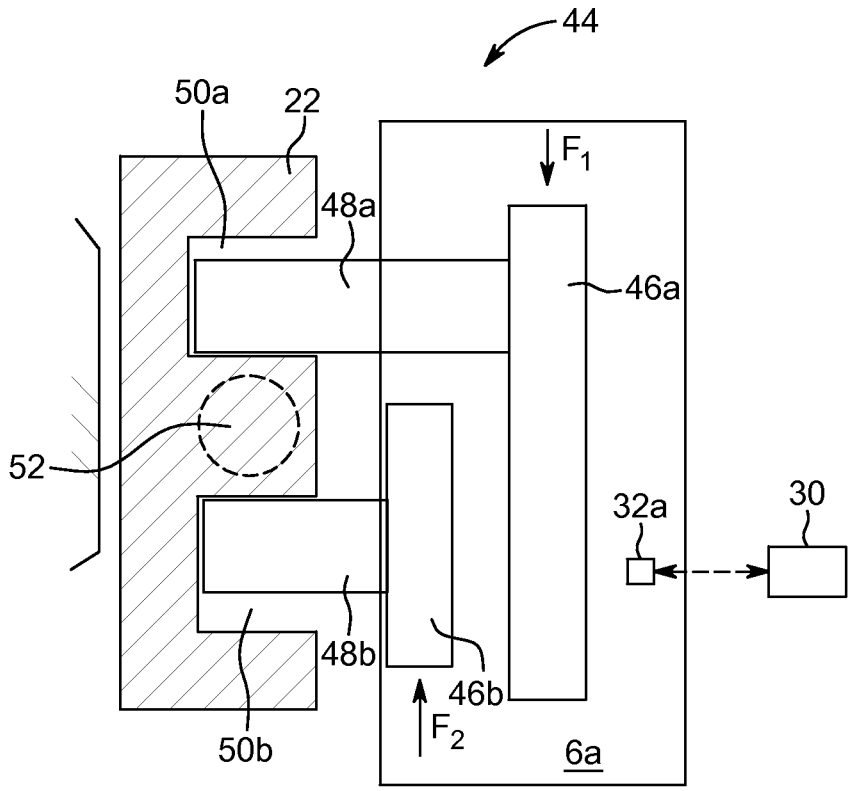
FIG. 7 is a side view of a clamping connection arrangement for the elevator arrangement of FIG. 1 in accordance with another aspect of the present disclosure.

With reference to FIG. 7, a friction clamping connection arrangement 44 is described. The friction clamping connection arrangement 44 may include at least two clamping members 46*a*, 46*b* positioned on the elevator car 6*a*. Each clamping member 46*a*, 46*b* may include at least one extension member 48*a*, 48*b* that extends from the elevator car 6*a* to the corresponding belt. In this connection arrangement 44, the drive belts 22 and start/stop belts 24*a*, 24*b* may include at least two longitudinal grooves 50*a*, 50*b* that are defined along the entire length of the drive belt 22 and/or start/stop belts 24*a*, 24*b*. It is also contemplated that additional extension members and/or grooves may be provided with the friction clamping connection arrangement 44 to provide a stronger and larger clamping force. The extension members 48*a*, 48*b* may be configured to extend into the grooves 50*a*, 50*b*, respectively. The extension members 48*a*, 48*b* may be configured to clamp onto a clamping portion 52 of the drive belt 22 to establish a friction force connection between the drive belt 22 and the elevator car 6*a*. As shown in FIG. 7, a first clamping force $F_1$ may be applied by the first clamping member 46*a* and a second clamping force $F_2$ may be applied by the second clamping member 46*b*. The first and second clamping forces $F_1$, $F_2$ are directed in generally opposite directions to create the clamping force on the clamping portion 52 of the drive belt 22. In one aspect, a slow ramp-up of the clamping force allows for a smoother load transfer between belt sets and limited slip during the load transfer. The first and second clamping forces $F_1$, $F_2$ may be activated or initiated by the master controller 30 via the car controller 32*a* or directly by the master controller 30.

Figure 8:
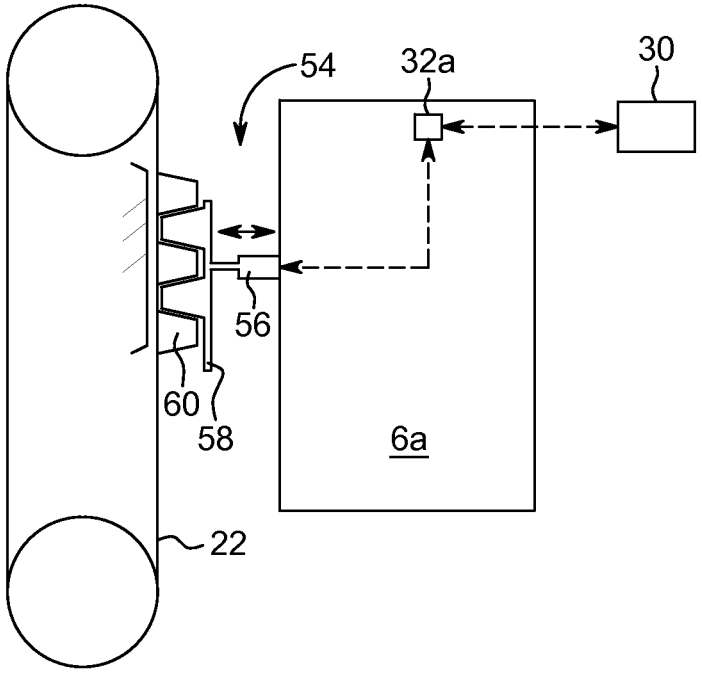
FIG. 8 is a side view of a positive locking connection arrangement for the elevator arrangement of FIG. 1 in accordance with another aspect of the present disclosure.

With reference to FIG. 8, a positive locking connection arrangement 54 is described. The positive locking connection arrangement 54 may include an actuator 56 provided on the elevator car 6*a* and a plurality of teeth 58 connected to a distal end of the actuator 56. The plurality of teeth 58 on the actuator 56 may be configured to engage and/or co-act with a corresponding plurality of teeth 60 provided on the drive belt 22. In one aspect, the actuator 56 may be controlled by the master controller 30 via the car controller 32*a* or directly by the master controller 30. The actuator 56 may be a pneumatic, hydraulic, electric, or mechanical actuator. The actuator 56 may be configured to move the plurality of teeth 58 in a substantially lateral or horizontal direction relative to the elevator car 6*a* to bring the plurality of teeth 58 into engagement with the plurality of teeth 60 of the drive belt 22. After both sets of teeth 58, 60 have interlocked with one another, the drive belt 22 may move the elevator car 6*a* in either an upward or downward direction. The plurality of teeth 60 provided on the drive belt 22 may move in unison with the drive belt 22 as the drive belt 22 rotates.

Figure 9:
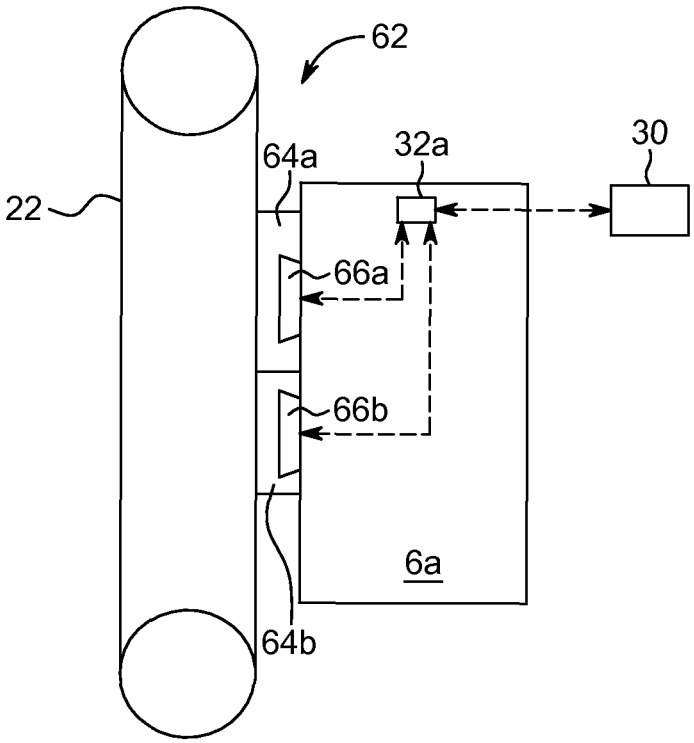
FIGS. 9 and 10 are side views of a pneumatic connection arrangement for the elevator arrangement of FIG. 1 in accordance with another aspect of the present disclosure.
Figure 10:
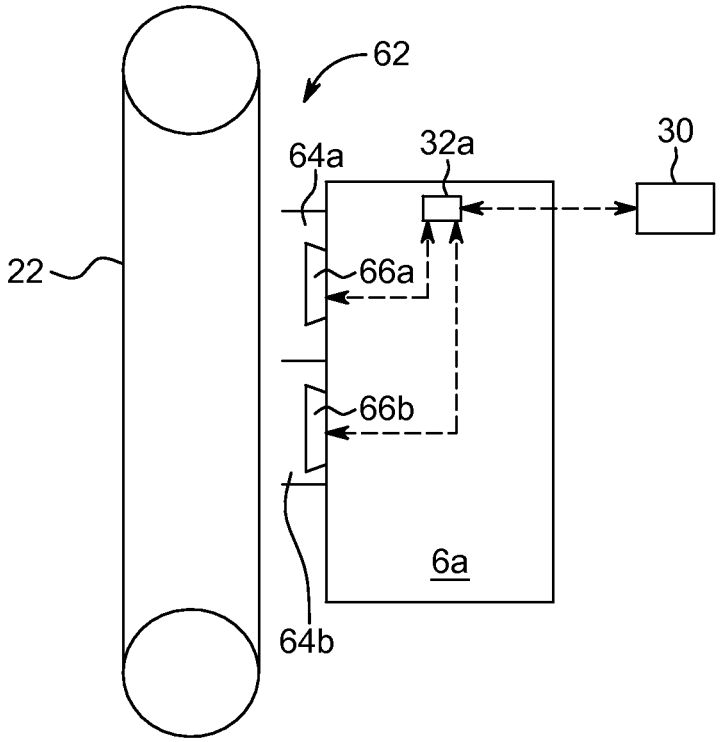

With reference to FIGS. 9 and 10, a pneumatic connection arrangement 62 is described. By using the pneumatic connection arrangement 62, a vacuum connection between the elevator car 6*a* and the drive belt 22 may be achieved using air pressure below atmospheric pressure. In this aspect, the drive belt 22 has a substantially smooth, flat surface that may be configured to create a sealing arrangement between a first and second vacuum chambers 64*a*, 64*b* and the drive belt 22. In one aspect, the first and second vacuum chambers 64*a*, 64*b* may be rigid enclosures that are provided on or attached to a portion of the elevator car 6*a*. The first vacuum chamber 64*a* may include a first vacuum pump 66*a*. The second vacuum chamber 64*b* may include a second vacuum pump 66*b*. The first and second vacuum pumps 66*a*, 66*b* may be configured to remove air and/or other gases from the first and second vacuum chambers 64*a*, 64*b*, respectively. After the first and second vacuum chambers 64*a*, 64*b* are brought into contact with the belt 22, the first and second vacuum pumps 66*a*, 66*b* remove the air from the first and second vacuum chambers 64*a*, 64*b*. In turn, the air pressure in the first and second vacuum chambers 64*a*, 64*b* is brought to a pressure level below atmospheric pressure. Once the pressure level reaches a predetermined level, the first and second vacuum chambers 64*a*, 64*b* create a vacuum that assists in holding the first and second vacuum chambers 64*a*, 64*b* against the drive belt 22. As shown in FIG. 9, when the pressure levels in the first and second vacuum chambers 64*a*, 64*b* are below atmospheric pressure, the first and second vacuum chambers 64*a*, 64*b* create a vacuum connection with the drive belt 22. As shown in FIG. 10, when the pressure levels of the first and second vacuum chambers 64*a*, 64*b* are at atmospheric pressure, the first and second vacuum chambers 64*a*, 64*b* are disconnected from the drive belt 22. In one aspect, the first and second vacuum pumps 66*a*, 66*b* may be activated/deactivated directly by the master controller 30 or by the master controller 30 through the car controller 32*a*.

It is to be understood that, while the connection arrangements described above have been shown in association with only one elevator car, any of the connection arrangements may be used with any belt to connect with any of the elevator cars. It is also contemplated that different connection arrangements may be provided on different belts to provide different types of connections between the belts and the elevator cars.

With reference to FIGS. 1-4, a method of moving at least two elevator cars independently of one another in at least one hoistway is described. As described above, the elevator arrangement 2 may be configured to operate within a building to move individuals between locations or floors in the building. During operation of the elevator arrangement 2, an individual may enter one of the elevator cars 6*a*-6*g* on one of the floors of the building. Using the corresponding car controller 32*a*-32*g* of the elevator car 6*a*-6*g*, a command may be sent to the master controller 30 to initiate the movement of the elevator car 6*a*-6*g* to a different floor or location. The master controller 30 may direct the elevator car 6*a*-6*g* to connect to at least one of the start/stop belts 24*a*, 24*b* of at least one of the hoistway belt sets 16*a*-16*d*, the upper exchanger belt sets 18*a*-18*d*, and the lower exchanger belt sets 20*a*-20*d* that is in a waiting position depending on the location of the elevator car 6*a*-6*g* in the elevator arrangement 2. After the corresponding motor 26*a*-26*l* establishes the necessary pre-torque level to properly and effectively move the elevator car 6*a*-6*g*, the corresponding safety rail brake system 28*a*-28*g* is opened smoothly and the corresponding start/stop belt 24*a*, 24*b* connects to the elevator car 6*a*-6*g* and begins to move the elevator car 6*a*-6*g*. The start/stop belt 24*a*, 24*b* and the elevator car 6*a*-6*g* may be connected via one of the connection arrangements described hereinabove.

Once the elevator car 6*a*-6*g* and the start/stop belt 24*a*, 24*b* achieve the nominal operating speed, the elevator car 6*a*-6*g* may disconnect from the start/stop belt 24*a*, 24*b* and connect with the drive belt 22. The nominal operating speed may be equal to the rotational speed of the drive belt 22. At this point during the operation of the elevator arrangement 2, the elevator car 6a-6g may be disconnected from the start/stop belt 24a, 24b and connected to the drive belt 22. Once the elevator car 6a-6g is fully connected to the drive belt 22, the start/stop belt 24a, 24b is available to accelerate/decelerate a new, different elevator car 6a-6g. As the elevator cars 6a-6g are moved upwards in the building, at least one other elevator car 6a-6g is moved downwards in the building. At least one advantage of using the elevator arrangement 2 is the direct mechanical energy transfer between elevator cars 6a-6g moving upwards and downwards. In one aspect, mechanical energy is understood to be the sum of the potential and kinetic energy of one of the elevator cars 6a-6g based on the motion and position of the elevator car 6a-6g. Energy losses in current linear motor systems used by current elevator arrangements that are typically due to the transfer of mechanical energy to electrical energy and then back again into mechanical energy will not apply to the mechanically connected elevator cars 6a-6g of the present elevator arrangement 2. The elevator cars 6a-6g may be mechanically connected to one another via at least one of the hoistway belt sets 16a-16d, the upper exchanger belt sets 18a-18d, and the lower exchanger belt sets 20a-20d. In one aspect, the mechanical energy that is generated by lowering one of the elevator cars 6a-6g in the elevator arrangement 2 may be used to move a different elevator car 6a-6g upwards in the elevator arrangement 2. For example, as shown in FIG. 3, as elevator cars 6a and 6g are moved downwards in the elevator arrangement 2, another elevator car 6d may be moved upwards with the mechanical energy generated by elevator cars 6a and 6g. Using the elevator arrangement 2, counterweights are no longer necessary to move the elevator cars 6a-6g to different locations.

After moving an elevator car 6a-6g near a desired location, the master controller 30 may send a command to the elevator car 6a-6g to stop at the desired location. In order to stop the elevator car 6a-6g, the elevator car 6a-6g may disconnect from the drive belt 22 and connect to an available start/stop belt 24a, 24b. Before the elevator car 6a-6g connects to the start/stop belt 24a, 24b, the start/stop belt 24a, 24b is accelerated until the start/stop belt 24a, 24b reaches the same speed as the drive belt 22. Once the start/stop belt 24a, 24b reaches the same speed as the drive belt 22, the elevator car 6a-6g is disconnected from the drive belt 22 and connected to the start/stop belt 24a, 24b. Once the elevator car 6a-6g is disconnected from the drive belt 22, the start/stop belt 24a, 24b moves the elevator car 6a-6g to the desired location or floor. As the elevator car 6a-6g comes to a stop and reduces its traveling speed to zero, the safety rail brake system 28a-g may be used to clamp or hold the elevator car 6a-6g to a support structure, such as a vertical guide rail. Once the elevator car 6a-6g is stopped, the start/stop belt 24a, 24b is disconnected from the elevator car 6a-6g and the start/stop belt 24a, 24b is made available for use with another elevator car 6a-6g.

It is also contemplated that a method of moving the elevator cars 6a-6g between different belt sets may be used with the elevator arrangement 2. As described above, air gaps 34 (see FIG. 6) are provided between the hoistway belt sets 16a-16d, the upper exchanger belt sets 18a-18d, and the lower exchanger belt sets 20a-20d. As the elevator car 6a-6g moves from one belt set to another belt set, the elevator car 6a-6g passes over the air gap 34. During this transition over the air gap 34, the elevator car 6a-6g may disconnect from a first belt set and then reconnect to a second belt set. In one aspect, as the elevator car 6a-6g moves over the air gap 34, the connection arrangement of the elevator car 6a-6g is disconnected from the first belt set. After passing over the air gap 34, the connection arrangement of the elevator car 6a-6g reconnects with the second belt set. Using the air gap 34 between the different belt sets, a smooth disconnection/connection is experienced by the elevator car 6a-6g. This provides an improvement over current elevator arrangements that use overlapping belt sets to move the elevator car between different belts sets, thereby causing a bumpy, turbulent connection/disconnection transition.

The method of moving the elevator cars 6a-6g in the elevator arrangement 2 may also include the use of the guiding systems 12a, 12b to move the elevator cars 6a-6g between different hoistways 4a-4c. After the elevator car 6a-6g has been moved from at least one of the hoistway belt sets 16a-16d to at least one of the upper exchanger belts sets 18a-18d or lower exchanger belt sets 20a-20d, the elevator car 6a-6g may be moved laterally or horizontally in the elevator arrangement 2 so as to be arranged in a different hoistway 4a-4c. One of the guiding systems 12a, 12b may grab or connect to the elevator car 6a-6g and move the elevator car 6a-6g to a different hoistway 4a-4c. In this manner, when one elevator car 6a-6g needs mechanical energy to move upwards to a desired location, at least one other elevator car 6a-6g may be moved to an adjacent hoistway 4a-4c to move downwards and generate the necessary mechanical energy.

By using the elevator arrangement 2 and method described above, several advantages are gained. Many of the components of the elevator arrangement 2 are standard components that may be used to economically manufacture and assemble the elevator arrangement 2. The elevator arrangement 2 also has a reduced building footprint, meaning the amount of space necessary to use or install the elevator arrangement 2 in a building. The elevator arrangement 2 does not typically include a machine room that may take up additional space. Further, the elevator arrangement 2 uses a fewer number of hoistways to lift a desired number of elevator cars compared to existing elevator arrangements and has a lower number of building interfaces. The elevator arrangement 2 also experiences a lower energy consumption. By using mechanically coupled elevator cars 6a-6g that move up and down at a nominal operating speed, the elevator arrangement 2 may generate and use its own mechanical energy. The elevator arrangement 2 also provides high ride comfort. By providing separate and optimized propulsion systems 14a-14d for the starting and stopping of the elevator cars 6a-6g and moving the elevator cars 6a-6g at a nominal operating speed, individuals riding in the elevator cars 6a-6g experience a smoother ride.

The elevator arrangement 2 also requires a minimal amount of standby power. In operation, the safety rail brake systems 28a-28g may be engaged with the elevator car 6a-6g if the elevator car 6a-6g is on the floor or is not moving. In this situation, the propulsion systems 14a-14d may be disconnected from the elevator cars 6a-6g and may be configured to switch to a sleep mode if not needed to move the elevator cars 6a-6g. The elevator arrangement 2 also includes smaller hoistways 4a-4c. Since the propulsion systems 14a-14d may be mounted on the walls of the hoistways 4a-4c or between the elevator cars 6a-6g, there is no interference between the elevator car 6a-6g doors and the propulsion systems 14a-14d or between the safety rail brake systems 28a-28g and the propulsion systems 14a-14d. The elevator arrangement 2 also assists in fast rescue operations and reliable operations of the elevator cars 6a-6g. The elevator cars 6a-6g may be moved with residual start/stop or nominal speed propulsion systems 14a-14d so if one propulsion system fails 14*a*-14*d*, another propulsion system 14*a*-14*d* may be used to move the elevator car 6*a*-6*g*. It is also contemplated that the elevator arrangement 2 may be retrofitted to be installed in an existing older building to replace an older hydraulic elevator arrangement. By using the elevator arrangement 2 in existing building space, the useable building space may be increased due to the small building footprint of the elevator arrangement 2. This increased useable building space may be provided due to the smaller hoistways 4*a*-4*c* of the elevator arrangement 2 or the multicar system of the elevator arrangement 2 that can satisfy higher travel demands in a building without adding additional elevator hoistways.

While various aspects of the elevator arrangement 2 and method of using the elevator arrangement 2 were provided in the foregoing description, those skilled in the art may make modifications and alterations to these aspects without departing from the scope and spirit of the disclosure. For example, it is to be understood that this disclosure contemplates that, to the extent possible, one or more features of any aspect may be combined with one or more features of any other aspect. Accordingly, the foregoing description is intended to be illustrative rather than restrictive. The invention described hereainbove is defined by the appended claims and all changes to the invention that fall within the meaning and the range of equivalency of the claims are to be embraced within their scope.

The invention claimed is:

1. An elevator arrangement, comprising:

two or more hoistways;

at least one more elevator car than a total number of hoistways; and at least one more belt system than the total number of hoistways, at least one belt system being provided between each pair of hoistways;

wherein at least one elevator car is provided in each hoistway;

wherein each elevator car is connected to at least one belt system; and wherein the belt systems provide a direct transfer of mechanical energy between the elevator cars.

2. The elevator arrangement as claimed in claim 1, wherein, as a first elevator car moves downward in a first hoistway, mechanical energy is generated via the belt systems to lift a second elevator car upwardly in a second hoistway.

3. The elevator arrangement as claimed in claim 1, wherein the at least one more elevator car than the total number of hoistways comprises at least three elevator cars; and the at least one more belt system than the total number of hoistways comprises at least three belt systems.

4. The elevator arrangement as claimed in claim 1, wherein the belt systems comprise a hoistway belt set positioned between an upper exchanger belt set and a lower exchanger belt set.

5. The elevator arrangement as claimed in claim 4, wherein an air gap is provided between each of the upper exchanger belt set, the hoistway belt set, and the lower exchanger belt set.

6. The elevator arrangement as claimed in claim 1, further comprising at least two guiding systems;

wherein at least one guiding system is provided at an upper portion of the elevator arrangement and at least one guiding system is provided at a lower portion of the elevator arrangement; and wherein the at least two guiding systems are configured to move the elevator cars between the hoistways.

7. The elevator arrangement as claimed in claim 1, further comprising a magnetic connection arrangement configured to establish a connection between each elevator car and the belt systems, wherein a magnetic force is established between each elevator car and the belt systems to hold each elevator car to the belt systems.

8. The elevator arrangement as claimed in claim 1, further comprising a friction clamping connection arrangement configured to establish a connection between each elevator car and the belt systems.

9. The elevator arrangement as claimed in claim 8, the friction clamping connection arrangement comprising at least two clamping members;

wherein the belt systems define at least two grooves configured to receive the at least two clamping members; and wherein the at least two clamping members are moved in opposite directions relative to one another to create a clamping force on a clamping portion between the at least two grooves in the belt systems.

10. The elevator arrangement as claimed in claim 1, further comprising a positive locking connection arrangement between each elevator car and the belt systems, the positive locking connection arrangement comprising a plurality of teeth provided on the belt systems and a plurality of teeth provided on each elevator car;

wherein the plurality of teeth provided on the belt systems positively interlock with the plurality of teeth provided on the elevator cars.

11. The elevator arrangement as claimed in claim 10, the positive locking connection arrangement further comprising an actuator on each elevator car configured to extend the plurality of teeth of each elevator car in a lateral direction relative to each elevator car.

12. The elevator arrangement as claimed in claim 1, further comprising a pneumatic connection arrangement between each elevator car and the belt systems, wherein the pneumatic connection arrangement creates a vacuum seal between each elevator car and the belt systems.

13. The elevator arrangement as claimed in claim 12, the pneumatic connection arrangement comprising at least one vacuum chamber and at least one vacuum pump provided in the at least one vacuum chamber, wherein the vacuum pump is configured to remove air from the vacuum chamber to bring the pressure level of the vacuum chamber below atmospheric level.

14. The elevator arrangement as claimed in claim 1, further comprising a master controller configured to communicate with each elevator car to activate each elevator car to move within the elevator arrangement.

15. The elevator arrangement as claimed in claim 14, further comprising at least one car controller provided in each elevator car, wherein the car controller is configured to communicate with the master controller.

16. The elevator arrangement as claimed in claim 1, wherein the belt systems comprise a drive belt and at least one start/stop belt.

17. The elevator arrangement as claimed in claim 1, further comprising at least one motor provided on the belt systems, wherein the at least one motor is configured to move the belt systems at a constant nominal speed.

* * * * *